US006220775B1

(12) United States Patent
Dottel

(10) Patent No.: US 6,220,775 B1
(45) Date of Patent: Apr. 24, 2001

(54) FOLDER PARTICULARLY FOR FILING ALL TYPES OF DOCUMENTS SUCH AS, FOR EXAMPLE, SHEETS, LOOSE SHEETS AND/OR THE LIKE, OPTIONALLY PERFORATED

(75) Inventor: Jean-Marc Dottel, Valenciennes (FR)

(73) Assignee: Achat et Distributton d'Articles de Classement "A D Classement", Valenciennes (FR)

( * ) Notice: Subject to any disclaimer, the term of this patent is extended or adjusted under 35 U.S.C. 154(b) by 0 days.

(21) Appl. No.: 09/308,121

(22) PCT Filed: Nov. 27, 1997

(86) PCT No.: PCT/FR97/02143

§ 371 Date: May 14, 1999

§ 102(e) Date: May 14, 1999

(87) PCT Pub. No.: WO98/25770

PCT Pub. Date: Jun. 18, 1998

(30) Foreign Application Priority Data

Dec. 11, 1996 (FR) ..... 96 15461

(51) Int. Cl.[7] ..... B42F 13/00

(52) U.S. Cl. ..... 402/73; 206/204; 206/425; 206/472; 281/21.1; 281/22; 281/28; 281/29; 281/31; 402/73; 402/77

(58) Field of Search ..... 209/204, 425, 209/472; 281/21.1, 22, 28, 29, 31; 402/77, 73

(56) References Cited

U.S. PATENT DOCUMENTS

| | | | | |
|---|---|---|---|---|
| 5,209,593 | * | 5/1993 | Ros | 402/77 |
| 5,971,650 | * | 10/1999 | Dottel | 402/73 |
| 6,030,140 | * | 2/2000 | Karten et al. | 402/73 |

FOREIGN PATENT DOCUMENTS

| | | |
|---|---|---|
| 375925 | 7/1990 | (EP) . |
| 480532 | 4/1992 | (EP) . |

* cited by examiner

*Primary Examiner*—A. L. Wellington
*Assistant Examiner*—Mark T. Henderson
(74) *Attorney, Agent, or Firm*—Harrison & Egbert

(57) ABSTRACT

A folder having spine and two lateral faces provided on either side of the spine. At least one of the lateral faces has, at its distal end, a turned edge directed toward the other lateral face so as to ensure the stability of the folder when placed in a vertical position. The folder also has a closer which integrates easily and aesthetically with the folder.

7 Claims, 2 Drawing Sheets

FIG. 1
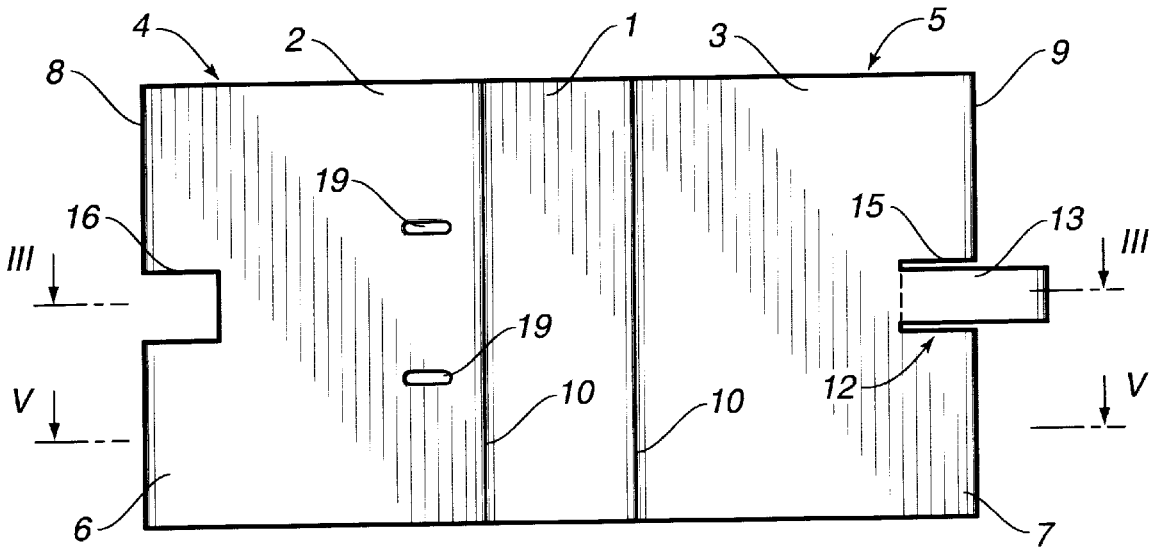
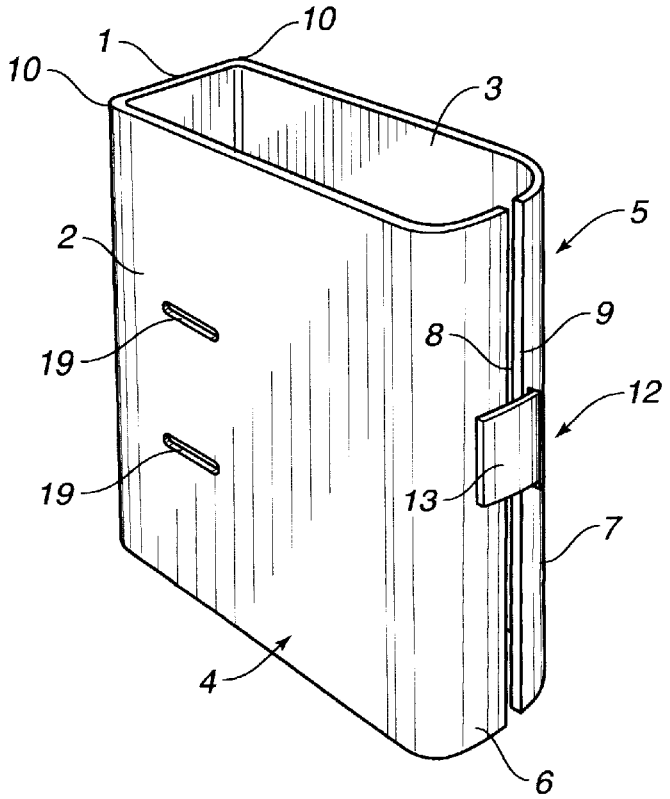
FIG. 2

FOLDER PARTICULARLY FOR FILING ALL TYPES OF DOCUMENTS SUCH AS, FOR EXAMPLE, SHEETS, LOOSE SHEETS AND/OR THE LIKE, OPTIONALLY PERFORATED

BACKGROUND OF THE INVENTION

1. Field of the Invention

The present invention relates to a folder. It can be designated, in particular, for filing any type of document, such as, sheets, loose leaves and/or the like, possibly perforated.

2. Description of the Related Art

Presently known folders are generally constituted by a back, or spine, and by tow planar lateral faces, provided on either side of the said spine. They can be provided with attaching members such as, rings, enabling the filed documents to be held in place.

Although they are to be found everywhere, such products have certain drawbacks. They are, in fact, first of all, unstable when placed vertically. In addition, they do not allow a minimum spacing to be maintained between their lateral faces.

The idea was thus hit upon of providing slots in one of the lateral faces, the said slots, having a special shape, or profile, being intended to cooperate with the rings forming the attaching members to impart stability to the files equipped therewith.

Nonetheless, such a solution necessitates numerous additional operations during manufacture and is very time consuming. In addition, it cannot be applied to other attaching members.

Furthermore, most presently known folders cannot be kept closed, or, when they are provided with members specially designed for this purpose, the latter detract from the overall aesthetic appearance of the folder and/or, as in the case of the slots mentioned earlier, necessitate numerous additional operations at the time of manufacture.

The object of the present invention is to provide a folder overcomes the aforementioned drawbacks and exhibits enhanced stability, particularly vertical stability.

Another object of present invention is to provide a folder that enables the spacing apart of its lateral faces to be maintained.

A further object of the present invention is to provide a file that can be provided with a closer that can be integrated easily and aesthetically in the folder.

Another object of the present invention is to provide a folder that can be manufactured simply and quickly, and that necessitates a minimum number of additional operations.

Further objects and advantages of the present invention will emerge in the course of the description that follows, which is given only by way of illustration and is not intended to limit same.

SUMMARY OF THE INVENTION

The present invention relates to a folder comprising a spine and two lateral faces, provided on either side of the said spine, characterized by the fact that one, at least, of the said lateral faces has, in the area of its distal end, a turn-in, directed towards the other lateral face, so as to ensure the stability of the folder in a vertical position.

BRIEF DESCRIPTION OF THE DRAWINGS

The invention will be more readily understood from a study of the following description, accompanied by the annexed drawings, which form an integral part thereof, and wherein:

FIG. 1 is a front view of an example of a folder according to the invention, as when spread flat;

FIG. 2 is a perspective view of an example of a folder according to the invention.

DETAILED DESCRIPTION OF THE INVENTION

Figure 3:
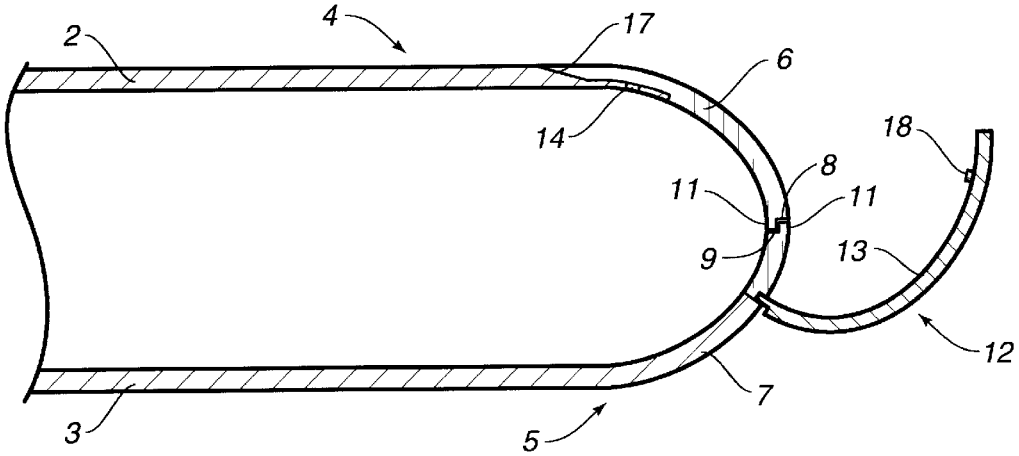
FIG. 3 is a partial cross-sectional view, along line III—III of preceding FIG. 1, of the folder illustrated in a closed position.

The present invention relates to a folder. It can be designed, in particular, for filing any type of document, such as, sheets, loose leaves and/or the like, possible perforated.

As shown in FIG. 1, the file according to the invention comprises a spine and two lateral faces, 2, 3, provided on either side of the spine 1.

With reference to FIG. 2, it will be noted that, according to the invention, one, at least, of the lateral faces 2, 3 has, in the area of its distal end 4, 5, a turn-in 6, 7, directed towards the other lateral face. The stability of the folder in a vertical position is thus ensured.

The 'distal end' is to be taken as meaning the side opposite the hinges 10 provided between the lateral faces 2, 3 and the spine 1.

As illustrated, each lateral face 2, 3, has one turn-in 6, 7, designed to be convergent.

The word "convergent" is to be taken as meaning that each turn-in 6, 7 forms an elbow in relation to its lateral face 2, 3 in the direction of turn-in 6, 7 located opposite on the other lateral face.

With more particular reference to FIG. 3, it will be noted that the turn-ins 6, 7 are, according to the exemplary embodiment illustrated, contiguous in the area of their distal edges 8, 9. The spacing apart of lateral faces 2, 3 of the folder is thus ensured by the edge to edge contact of the turn-ins 6, 7.

The spacing can correspond, in particular, to the width of spine 1 of the folder, that is to say to the dimension of spine 1 in the direction perpendicular to hinges 10, referred to as dorsal edges.

The turn-ins 6, 7 are provided, as applicable, along their distal edges 8, 9, in their thickness, with shoulders 11, suitable for co-operating with one another. The latter make it possible, to improve the relative positioning of the said lateral faces 2, 3 when their turn-ins 6, 7 are contiguous.

Referring once more to FIG. 1, it will be noted that the said spine 1 and the lateral faces 2, 3 are, in particular, substantially rectangular and have the same dimensions which define according to a first example, the height of the file.

As apparent from FIG. 2, the turn-ins 6, 7 are, possibly, provided along the entire said height. They can also be partial.

If, according to forms of embodiment differing from those illustrated, the spine 1 and the lateral faces 2, 3 were not of the same height, the height of the folder could then be defined either by the width dimension of the spine 1, or by the width dimension of the said lateral faces 2, 3. The height of the said turn-ins 6, 7 could then correspond to one or the other of the two width dimensions.

According to yet other forms of embodiment, the lateral faces 2, 3 could also have turn-ins 6, 7 only partially along their distal ends.

This being the case, the turn-ins 6, 7 are, in particular, symmetrical. The may have a curve shape, a polygonal shape or a sharp angle In relation to the lateral faces 2, 3.

According to the different forms of embodiment illustrated, the turn-ins. 6, 7 are contiguous with their lateral faces 2, 3 and form a rigid assembly therewith. This means that the turn-ins 6, 7 are not hinged in relation to the lateral faces 2, 3.

As described in more detail hereinafter, the turn-ins 6, 7 and the lateral faces 2, 3 are possibly designed to be in one piece.

Figure 4:
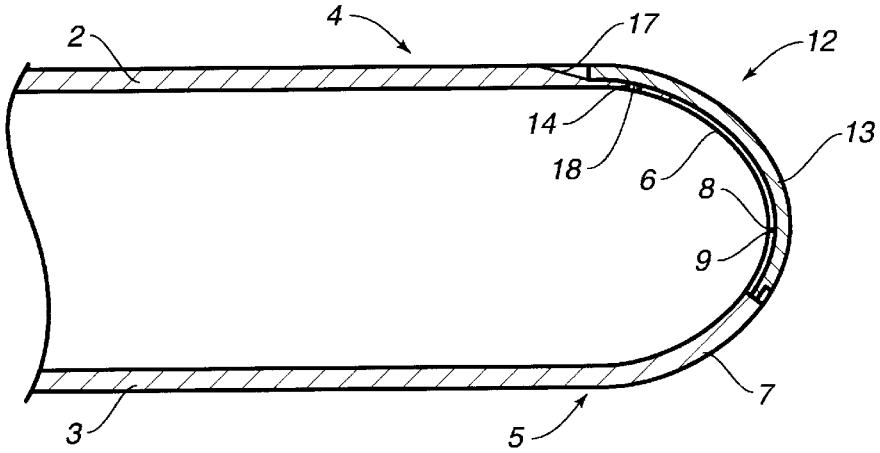
FIG. 4 is a view according to preceding FIG. 3, the folder being in a locked condition.

With reference now to FIGS. 3 and 4, it will be noted that the turn-ins comprise, In particular, means 12 for closing the folder. The closer further comprises, a hook element, 13, on a first turn-in 7, a slot 14 on a second turn-in edge 6, the hook element 13 and the said slot 14 being capable of co-operating to ensure that the turn-ins 6, 7 are held in relation to one another, or even held together.

The hook element 13 has, possibly, a certain degree of elasticity and, in particular, a profile that is substantially identical with that of the turn-ins 6, 7, so as to enable it to be placed under tension after being inserted into the slot 14. Thus, when, as illustrated, distal edges 8, 9 of the turn-ins 6, 7 are contiguous. The hook element 13 makes it possible to improve the closing of the folder while, at the same time, it blends in with the aesthetic appearance of the latter.

As shown in FIG. 1, the first turn-in, 7, has, in particular, a first cut out portion, 15, provided in its distal edge 9 and orientated orthogonally in relation to the distal edge 9. The first cut out portion defines the hook element 13 in the form of a tab and is positioned in relation to the first turn-in 7 at the bottom of the first cut out portion 15.

Similarly, the second turn-in 6 has, in particular, second cur out portion 16 being U-shaped and opposite said first cut out portion, said second cut out portion having said slot capable of receiving the hook element 13. The slot 14, is oriented parallel to the bottom of the second cut out portion 16.

With further reference to FIGS. 3 and 4, it will be noted that the second turn-in 6 further, possibly, has, in its thickness, an oblique area, 17, suitable for facilitating the opening of the folder.

The hook element 13 is provided, with a protuberance 18, suitable for co-operating with the slot 14, provided in the second turn-in 6, or in a panel mounted in the area of the inner side of the folder.

According to other forms of embodiment, not shown, the said hook element 13 is provided, in the area of its lateral edges, in its thickness, with protuberances, suitable for co-operating with orifices provided in the thickness of the second turn-in, 6, in the area of the lateral edges of the second cut out portion 16.

This being the case, although they are no longer needed to ensure the stability of the folder and the spacing apart of its lateral faces 2, 3, slots 19 can be provided on one of the lateral faces, 2, 3, to co-operate with attaching means, possibly constituted by rings provided in the folder.

The height of the attaching means is adjusted, in particular, via a housing of greater or lesser depth, provided in lateral face 3 to which the attaching means may possibly be secured, the housings being suitable for receiving the said attaching means.

Furthermore, as already mentioned, the lateral sides 2, 3 and the said turn-ins 6, 7 can, possibly, be made in one piece as, in particular, can the hook element 13.

Figure 5:
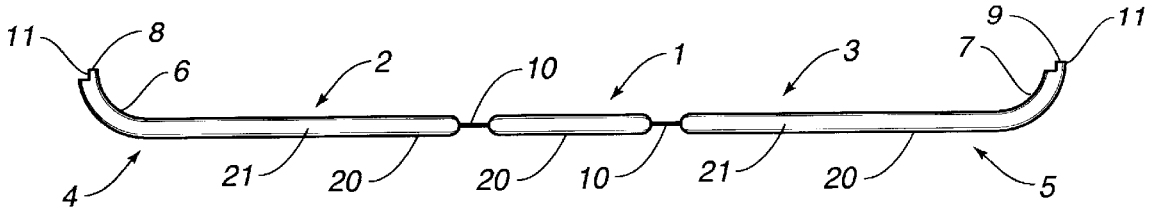
FIG. 5 is a cross-sectional view along line V–V of preceding FIG. 1.

With reference to FIG. 5, its will be noted, in this connection, that the said folder comprises, one or more panels of material defining a shell, 20, having a cavity, 21, possibly obtained by blow moulding. Such a structure makes it possible, in particular, to improve the rigidity of the folder.

According to the form of embodiment illustrated, only one panel of material is provided, and the dorsal edges 10 and/or the hinge portion of hook element 13 are constituted, in particular, by the shell 20, the inner and outer walls of which have been locally pressed against one another.

Other forms of embodiment, within the grasp of a man of the art, could, of course, have been contemplated without thereby departing from the scope of the present invention.

What is claimed is:

1. A folder comprising:

a spine;

a first lateral face on one side of said spine, said first lateral face having a turn-in contiguous therewith at a distal end thereof;

a second lateral face on an opposite side of said spine, said second lateral face having, a turn-in contiguous therewith at a distal end thereof, said turn-in of said second lateral face being directed toward said first lateral face so that said spine and said first lateral face and said second lateral face can stand stably upright in a vertical position a hook element formed on said turn-in of said first lateral face;

a slot formed on said turn-in of said second lateral face, said hook element being engagable with said slot so as to selectively join the respective turn-ins of said first and second lateral faces together, said hook element having a profile substantially identical to a profile of said turn-in of said first lateral face, said hook element being under tension when engaged in said slot.

2. The folder of claim 1, said turn-in of said first lateral face and said turn-in of said second lateral face spacing said first lateral face from said second lateral face.

3. The folder of claim 1, each of said turn-ins has a shoulder on an outer edge thereof such that the shoulder of a respective turn-in cooperates with the shoulder of the other turn-in.

4. The folder of claim 1, wherein said turn-ins along an entire of the respective distal end.

5. The folder of claim 1, wherein said turn-in of each of said respective lateral faces has a curved shape.

6. The folder of claim 1, wherein said turn-ins and said lateral faces are of a unitary construction.

7. The folder of claim 1, further comprising:

a first cut-out portion formed on an outer edge of said turn-in of said first lateral face, said first cut-out portion being orthogonally oriented relative to said outer edge, said hook element being hingedly connected to a bottom of said first cut-out portion; and a second cut-out portion formed on an outer edge of said turn-in of said second lateral face in a location corresponding to said first cut-out portion, said second cutout portion being U-shaped and adapted to receive said hook element, said slot being oriented parallel to a bottom of said second cut-out portion.

* * * * *